US008172444B2

(12) United States Patent
Chan et al.

(10) Patent No.: US 8,172,444 B2
(45) Date of Patent: May 8, 2012

(54) LIGHT GUIDE DISPLAY WITH MULTIPLE LIGHT GUIDE LAYERS

(75) Inventors: Chuan Hoe Chan, Penang (MY); Sian Tatt Lee, Penang (MY); Choon Guan Ko, Sungai Dua (MY); Fook Chuin Ng, Taman Bayu (MY)

(73) Assignee: Avago Technologies ECBU IP (Singapore) Pte. Ltd., Singapore (SG)

( * ) Notice: Subject to any disclaimer, the term of this patent is extended or adjusted under 35 U.S.C. 154(b) by 329 days.

(21) Appl. No.: 12/429,972

(22) Filed: Apr. 24, 2009

(65) Prior Publication Data

US 2010/0271839 A1 Oct. 28, 2010

(51) Int. Cl.
*F21V 7/04* (2006.01)

(52) U.S. Cl. ..... 362/602; 362/616; 362/612

(58) Field of Classification Search ..... 362/602, 362/616

See application file for complete search history.

(56) References Cited

U.S. PATENT DOCUMENTS

| | | | | |
|---|---|---|---|---|
| 2007/0236959 | A1* | 10/2007 | Tolbert et al. | 362/616 |
| 2008/0117635 | A1 | 5/2008 | Chen | |
| 2008/0192012 | A1 | 8/2008 | Chang et al. | |
| 2009/0180282 | A1* | 7/2009 | Aylward et al. | 362/245 |
| 2009/0219734 | A1* | 9/2009 | Sawada et al. | 362/616 |

FOREIGN PATENT DOCUMENTS

| | | | |
|---|---|---|---|
| CN | 101241206 | A | 8/2008 |
| WO | 2004006214 | A1 | 1/2004 |

* cited by examiner

*Primary Examiner* — Evan Dzierzynski

(57) ABSTRACT

A light guide display includes a printed overlay layer, a first light guide layer, and a second light guide layer. The printed overlay layer includes an input region with a symbol that is at least partially translucent. The first light guide layer is disposed on a back side of the printed overlay layer to illuminate the symbol of the printed overlay layer in response to illumination of the first light guide layer. The second light guide layer is disposed on a front side of the printed overlay layer, opposite the first light guide layer. The second light guide layer includes a separate symbol that is distinct from the symbol of the printed overlay layer. The second light guide layer illuminates the separate symbol of the second light guide layer in response to illumination of the second light guide layer.

18 Claims, 8 Drawing Sheets

LIGHT GUIDE DISPLAY WITH MULTIPLE LIGHT GUIDE LAYERS

BACKGROUND

There is a trend in the consumer electronics market to increase performance of electronic devices while reducing the form factor of the electronic devices. The trend to miniaturize electronic devices depends on the ability to make and implement smaller components within the electronic devices.

Optical keypads are one type of component that has been miniaturized, to a degree. Optical keypads generally include any type of input device with illuminated buttons or input regions. As one example, many types of conventional mobile phones use optical keypads with buttons, or keys, for input of alphanumeric characters.

FIG. 1 depicts a conventional optical keypad system. The conventional optical keypad system 10 includes a processor circuit 12, a light emitting diode (LED) 14, and a keypad stack. The keypad stack includes a keypad layer 16, a light guide layer 18, and a switch circuit 20. The keypad layer 16 includes several keys 22, or buttons, that are raised portions for tactile contact by a user. The keypad layer 16 is generally opaque, except for translucent portions 24 which are in the form of letters, numbers, or other symbols. The processor circuit 12 controls the LED 14 to illuminate the light guide layer 18, which generally uses total internal reflection (TIR) to distribute the light within the light guide layer 18. The light guide layer 18 includes surface feature patterns 26 (e.g., bumps or depressions) which disrupt the TIR within the light guide layer 18 and cause light to exit the light guide layer 18 towards the translucent portions 24 of the keypad layer 16. In this way, the light guide layer 18 provides backlight illumination for the keypad layer 16. The keys 22, or buttons, of the keypad layer 16 are aligned with switching devices 28 (e.g., dome switches) of the switch circuit 20, so that depression of a key 22 activates a corresponding switching device 28. The processor circuit 12 recognizes activation of the switching device 28 and may implement corresponding functionality.

In order to maintain a relatively small size of the overall electronic device, some optical keypads use a thin light guide film (LGF) to provide backlight illumination for the keys, or buttons, on the keypad. Generally, a light guide film is a planar light guide made of polycarbonate (PC) or a similar material. The light guide film is inserted behind the keypad, in between the keypad (also referred to as a keymat) and a switch circuit (e.g., a dome-pad layer). The light guide film is illuminated (e.g., by a LED) and reflects some of the light out at specific locations of the keypad. In this way, the individual keys, or buttons, on the keypad are illuminated.

While the use of a thin light guide film for backlight illumination of the keypad facilitates a relatively small implementation of an optical keypad, the use of the keys, or buttons, on the keypad are limited to the illumination of fixed characters integrated into the keypad. Hence, at a single location on the keypad, only one key character can be illuminated because the character locations are fixed on the keypad. Additionally, when the optical segments or icons on the keypad are spaced closely together, it can be difficult to separately illuminate different segments or icons of the keypad without light leakage to other segments oricons.

SUMMARY

Embodiments of an apparatus are described. In one embodiment, the apparatus is a light guide display. An embodiment of the light guide display includes a printed overlay layer, a first light guide layer, and a second light guide layer. The printed overlay layer includes an input region. The input region includes a symbol that is at least partially translucent through a thickness of the printed overlay layer. The first light guide layer is disposed on a back side of the printed overlay layer. The first light guide layer receives light and distributes the light at least partially according to total internal reflection (TIR) to an illumination region aligned with the symbol of the printed overlay layer. The first light guide layer illuminates the symbol of the printed overlay layer in response to illumination of the first light guide layer. The second light guide layer is disposed on a front side of the printed overlay layer, opposite the first light guide layer. The second light guide layer includes a separate symbol that is distinct from the symbol of the printed overlay layer. The second light guide layer illuminates the separate symbol of the second light guide layer in response to illumination of the second light guide layer. Other embodiments of the apparatus are also described.

Embodiments of a system are also described. In one embodiment, the system is an electronic computing device. An embodiment of the electronic computing device includes a light guide display, an illumination circuit, and a processor circuit. The light guide display includes a plurality of light guide layers. Each light guide layer corresponds to a unique set of user input selections. The illumination circuit independently illuminates each light guide layer. The processor circuit is coupled to the light guide display to independently enable each unique set of user input selections during illumination of the corresponding light guide layer. Other embodiments of the system are also described.

Embodiments of a method are also described. In one embodiment, the method is a method for manufacturing a light guide display. In one embodiment, the method includes disposing a first light guide layer on a back side of a printed overlay layer. The printed overlay layer includes a plurality of input regions with at least partially translucent portions. The method also includes disposing a first light source for optical communication with the first light guide layer. The first light source illuminates the first light guide layer. The first light source also illuminates the at least partially translucent portions of the input regions on the printed overlay layer upon illumination of the first light guide layer. The method also includes disposing a second light guide layer on a front side of the printed overlay layer. The second light guide layer includes a plurality of separate symbols that are distinct from the symbols of the printed overlay layer. The method also includes disposing a second light source for optical communication with the second light guide layer. The second light source illuminates the separate symbols of the second light guide layer. Other embodiments of the method are also described.

Other aspects and advantages of embodiments of the present invention will become apparent from the following detailed description, taken in conjunction with the accompanying drawings, illustrated by way of example of the principles of the invention.

BRIEF DESCRIPTION OF THE DRAWINGS

Throughout the description, similar reference numbers may be used to identify similar elements.

DETAILED DESCRIPTION

Figure 1:
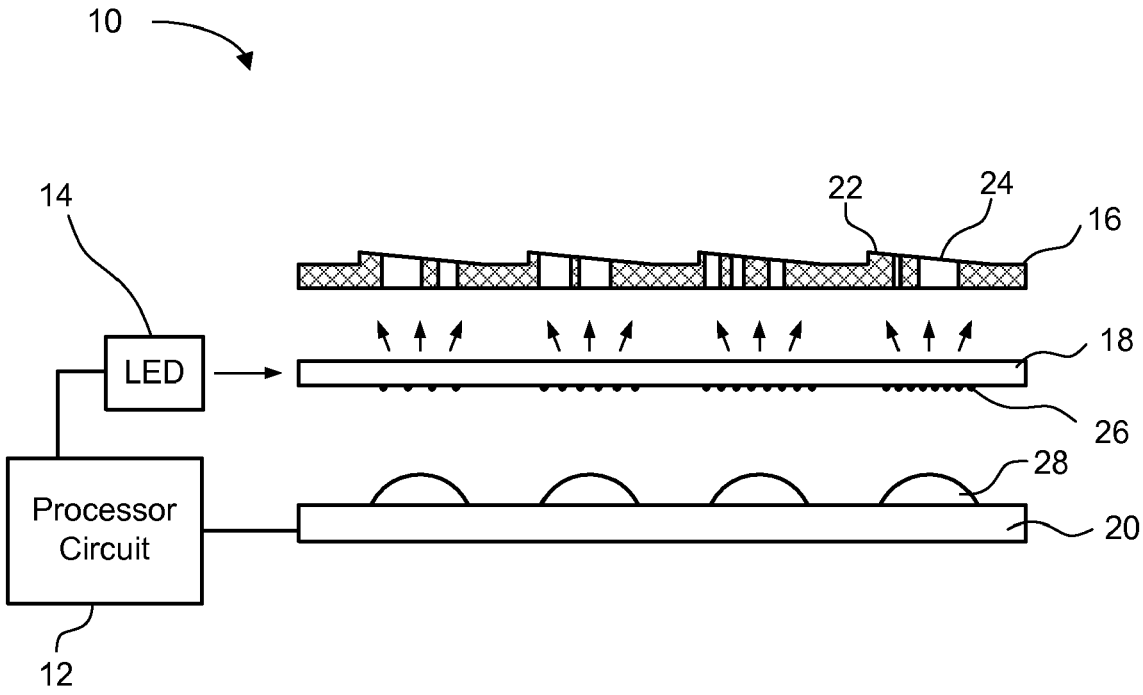
FIG. 1 depicts a conventional optical keypad system.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment of the present invention. Thus, the phrases "in one embodiment," "in an embodiment," and similar language throughout this specification may, but do not necessarily, all refer to the same embodiment.

While many embodiments are described herein, at least some of the described embodiments implement a light guide display with multiple light guide layers. The implementation of multiple light guide layers within a light guide display facilitates illumination of different switch buttons at the same location on the light guide display. For example, two different symbols can be separately displayed, at different times, at a single location on the light guide display. By displaying different symbols at the same location, the total number of buttons on the light guide display can be reduced. For example, if two light guide layers are implemented, then the total number of symbols that can be displayed is twice as many compared with a single light guide layer. Hence, the total number of symbol locations can be reduced to about half compared with a single light guide layer implementation. By reducing the total number of symbol locations, the overall size of the device may be reduced. Hence, overall dimensions, tooling, and assembly costs could be lowered substantially by implementing a light guide display with multiple overlapping light guide layers.

In some embodiments, the light guide display with two overlapping light guide layers is referred to as a light guide display with a double layered overlay. Embodiments of the double layered overlay are able to produce illuminated key characters in overlapping and inter-changeable positions, so that one symbol is displayed when one of the light guide layers is illuminated, and a different symbol is displayed in the same location when the other light guide layer is illuminated. In this way, the two light guide layers operate to exhibit a graphical changing effect on the light guide display.

Figure 2A:
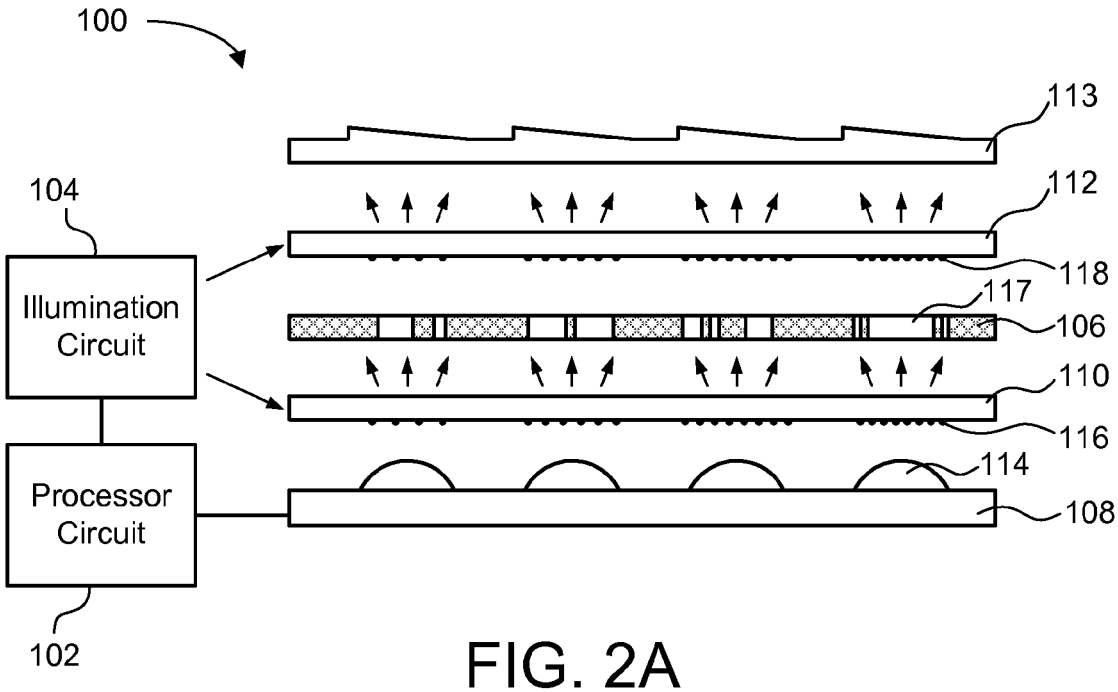
FIG. 2A depicts a schematic block diagram of one embodiment of a light guide display.

FIG. 2A depicts a schematic block diagram of one embodiment of a light guide display 100. Embodiments of the light guide display 100 may be implemented in various types of mobile electronic computing devices such as cellular telephones (cell phones) and personal digital assistants (PDAs). Additionally, some embodiments of the light guide display 100 may be implemented in other types of portable or non-portable electronic devices.

The illustrated light guide display 100 includes a processor circuit 102 and an illumination circuit 104. The light guide display 100 also includes a stack of various layers, including a printed overlay layer 106, a switch circuit 108, a first light guide layer 110, and a second light guide layer 112. The illustrated light guide display 100 also includes a keypad layer 113. Although the light guide display 100 is shown and described with certain components and functionality, other embodiments of the light guide display 100 may include fewer or more components to implement less or more functionality.

In general, the processor circuit 102 functions to operationally control the functionality of the light guide display 100. The processor circuit 102 may be any type of general purpose or specific purpose processing device to store and/or execute instructions, or to otherwise implement logical operations, related to the operation of the light guide display 100. In particular, embodiments of the processor circuit 102 control the illumination circuit 104. The processor circuit 102 also processes signals (e.g., user input signals) from the switch circuit 108 and may communicate those signals or related signals to other components within an electronic computing device.

In one embodiment, the illumination circuit 104 is controlled by the processor circuit 102 to generate illumination for the first and second light guide layers 110 and 112. The illumination circuit 104 may have a single light source or multiple light sources. Each light source may be a light emitting diode (LED), a laser, or another type of light source. Additionally, some embodiments of the illumination circuit 104 may include more than one light source for each light guide layer.

In general, the keypad layer 113 provides an interface for a user to make various input selections such as alphanumeric or symbolic selections. The light guide display 100 described herein is not limited to any particular types of input selections. As shown, the keypad layer 113 may include distinct raised portions on a base layer to delineate the various input regions. Other embodiments may use a keypad layer 113 which is substantially planar (as shown) or which has depressed portions corresponding to the various input regions. In one embodiment, the keypad layer 113 is substantially translucent so that a user can view portions of the printed overlay layer 106 below the keypad layer 113.

The printed overlay layer 106 is generally opaque and includes one or more translucent, or semi-translucent, portions 117 for each input region. The translucent portions 117 are translucent through the thickness of the printed overlay layer 106 so that backlight illumination can transmit through the printed overlay layer 106 and be visible to a user through the substantially translucent keypad layer 113. As one example, the printed overlay layer 106 may include alphanumeric characters that are translucent to allow backlight illumination to illuminate the form of each alphanumeric character (refer to FIG. 3B).

The switch circuit 108 includes various switching devices 114 on a substrate. In some embodiments, the substrate is a printed circuit board (PCB), although other embodiments may use other types of substrates. The individual switching devices 114 are aligned with the input regions of the keypad layer 113. The switching devices 114 may be any type of switching devices, including dome switches or other mechanical, electromechanical, or optical switching devices. In one embodiment, upon contact with or depression of a particular input region on the keypad layer 113, the corresponding switching device 114 is activated to generate a switching signal indicative of the input region that is selected. In some embodiments, each switching device 114 may correspond to multiple input selections, depending on which light guide layer is illuminated at the time of the selection, as explained in more detail below.

The first light guide layer 110 is interposed between the printed overlay layer 106 (i.e., on the back side of the printed overlay layer 106) and the switch circuit 108 to provide backlight illumination for the printed overlay layer 106. In one embodiment, the illumination circuit 104 emits light to illuminate the first light guide layer 110, which propagates the light by total internal reflection (TIR) across the length and/or width of the printed overlay layer 106. More specifically, the illumination circuit 104 emits light into the first light guide layer 110 through a light interface surface (i.e., the side surface) of the first light guide layer 110.

The first light guide layer 110 includes a substantially translucent layer with multiple surface feature patterns 116. The substantially translucent layer has a top surface and a bottom surface, which are in corresponding top and bottom major planes of the substantially translucent layer, at least when the substantially translucent layer is disposed in a relatively flat configuration (i.e., not bent or deformed). The substantially translucent layer propagates light internally through TIR between the top and bottom surfaces of the substantially translucent layer.

In some embodiments, the first light guide layer 110 is a flexible film that conforms to the shape of the back side of the printed overlay layer 106. The first light guide layer 110 may be fabricated from any number of materials, including but not limited to polycarbonate (PC), polyurethane (PU), polyethylene terephthalate (PET), or acrylic glass (polymethyl methacrylate ((PMMA)). Additionally, the thickness of the first light guide layer 110 may vary, although some examples of thicknesses are 0.1 mm, 0.125 mm, 0.2 mm, 0.25 mm, 0.3 mm, 0.38 mm, 0.5 mm, 0.6 mm, 0.8 mm, and 1.0 mm. Other embodiments may use another type of flexible or semi-flexible material and/or have other physical dimensions.

The surface feature patterns 116 of the first light guide layer 110 are generally located at one or both surfaces of the first light guide layer 110. In the depicted embodiment, the surface feature patterns 116 are located on the bottom surface of the first light guide layer 110. However, other embodiments may include surface feature patterns 116 on the top surface of the first light guide layer 110 instead of, or in addition to, the surface feature patterns 116 on the bottom surface of the first light guide layer 110.

Each surface feature pattern 116 includes a plurality of non-planar surface features such as raised portions (as shown in FIG. 2A) or depressions (i.e., indentations or dimples, not shown) which are out-of-plane with a major surface of the first light guide layer 110. It should be noted that the term "out-of-plane" as used in reference to the top and bottom surfaces means that the individual surface features extend out of or into the corresponding top or bottom surfaces of the first light guide layer 110. However, the description of out-of-plane surface features does not require that the first light guide layer 110 be disposed in a planar configuration. Rather, flexible or deformable embodiments of the first light guide layer 110 may be bent or deformed, even though the surface features extend out of or into the corresponding top or bottom surfaces of the first light guide layer 110.

As one example of a surface feature pattern 116, the illustrated embodiment includes raised bumps which protrude out of the plane of the bottom surface of the first light guide layer 110. In other embodiments, the surface feature patterns 116 could include a pattern of dimples, or depressions, that penetrate above the plane of the bottom surface of the first light guide layer 110. In some embodiments, the surface feature patterns 116 are referred to as micro-structure patterns because of the small size of each individual surface feature. As one example, the surface feature patterns 116 may include hemispherical depressions having a diameter of about 80 μm and an indentation depth of about 15 μm. Other embodiments may have other dimensions. Additionally, other embodiments may have surface features which are round, conical, quadrangular, pyramidal, or another canonical or non-canonical shape.

In general, each surface feature pattern 116 disrupts the TIR within the first light guide layer 110. The change in surface area and angle of incidence resulting from the raised or depressed surface features allows at least some of the light in the first light guide layer 110 to exit the first light guide layer 110 at approximately the locations of the surface feature patterns 116. In FIG. 2A, the exiting light is shown by the arrows pointing away from the surface feature patterns 116 and towards the back side of the printed overlay layer 106. Since some of the light exits at each of the surface feature patterns 116 and, hence, the amount of light that is internally reflected diminishes as the light propagates away from the illumination circuit 104, the surface feature patterns 116 of the depicted first light guide layer 110 have different pattern densities. In particular, the surface feature patterns 116 are less dense (i.e., spread apart) near the illumination circuit 104 and more dense (i.e., closer together) farther away from the illumination circuit 104. The less dense surface feature patterns 116 near the illumination circuit 104 provide a relatively small disruption to the TIR and, hence, allow a relatively small amount of the total light to escape, because the amount of total light in the first light guide layer 110 is relatively high near the illumination circuit 104. Conversely, the denser surface feature patterns 116 farther away from the illumination circuit 104 provide a relatively large disruption to the TIR and, hence, allow a relatively large amount of the total light to escape, because the total light in the first light guide layer 110 is relatively low farther away from the illumination circuit 104 (due in part to the light which exits at each of the surface feature patterns 116 which are closer to the illumination circuit 104).

In one embodiment, the surface feature patterns 116 of the first light guide layer 110 are aligned with the input regions of the printed overlay layer 106. More specifically, the surface feature patterns 116 of the first light guide layer 110 are aligned with the translucent portions 117 of the printed overlay layer 106. In this way, the light that exits the first light guide layer 110 at the surface feature patterns 116 illuminates the symbols (or a portion of the input regions) of the printed overlay layer 106.

The second light guide layer 112 is substantially similar in many aspects to the first light guide layer 110, except that the second light guide layer 112 is disposed on the front side of the printed overlay layer 106, opposite the first light guide layer 110 which is on the back side of the printed overlay layer 106. Also, as another difference, the surface feature patterns 118 of the second light guide layer 112 have an additional function of illuminating specific symbols or patterns of the second light guide layer 112. In some embodiments, the symbols of the second light guide layer 112 are separate and distinct (i.e., a unique set of input selections) from the symbols of the printed overlay layer 106, which are illuminated by the light from the first light guide layer 110. Thus, while the first light guide layer 110 functions in combination with the printed overlay layer 106 to illuminate the symbols of the printed overlay layer 106, the second light guide layer 112 has symbols integrated into the structure of the second light guide layer 112. So there is no need for an additional printed overlay layer 106 to be illuminated by the light from the second light guide layer 112. In other embodiments, the symbols of the second light guide layer 112 may be partially or wholly formed by other features that are embedded within the second light guide layer 112, rather than on a surface of the second light guide layer 112.

Generally, the illumination circuit 104 operates to illuminate only one of the first and second light guide layers 110 and 112 at a time. Since the illumination of each light guide layer makes different symbols viewable to a user, and concurrent illumination of multiple light guide layers would illuminate different symbols in overlapping locations, the processor circuit 102 operates to control when each of the first and second light guide layers 110 and 112 is exclusively illuminated. At the same time, the processor circuit 102 enables different functionality for each input region, depending on which light guide layer is illuminated. In this way, the processor circuit 102 can implement a first function in response to a selection of a viewable region during illumination of the symbol of the printed overlay layer 106. At a different time, when the second light guide layer 112 is illuminated, the processor circuit 102 can implement a second function in response to a selection of the viewable region during illumination of the separate symbol of the second light guide layer 112. Accordingly, in some embodiments, the illumination circuit 104 illuminates at most one light guide layer at a time, and the processor circuit 102 enables a unique set of user input selections corresponding to the illuminated light guide layer.

Figure 2B:
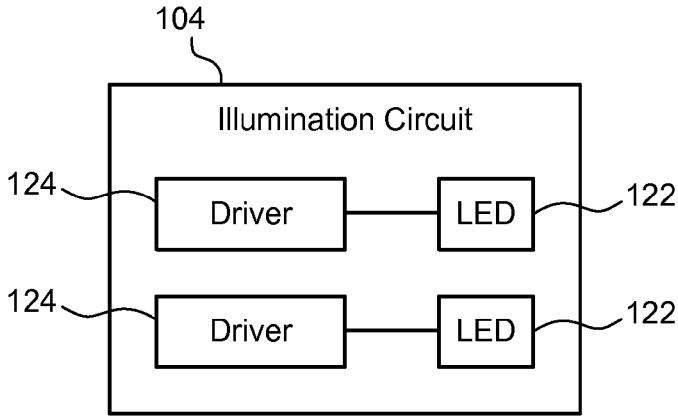
FIG. 2B depicts a schematic block diagram of one embodiment of the illumination circuit of the light guide display shown in FIG. 2A.

FIG. 2B depicts a schematic block diagram of one embodiment of the illumination circuit 104 of the light guide display 100 shown in FIG. 2A. The illustrated illumination circuit 104 includes multiple LEDs 122 and corresponding drivers 124. Each LED 122 serves as a light source for one of the light guide layers 110 and 112. Each driver 124 is controlled by the processing circuit 102 to generate driver signals which cause the corresponding LEDs 122 to generate light. In particular, a first LED 122 emits light to illuminate an internal portion of the first light guide layer 110. Similarly, a second LED 122 emits light to illuminate an internal portion of the second light guide layer 112. As explained above, both of the first and second light guide layers 110 and 112 distribute the light at least partially according to TIR.

Although the illumination circuit 104 illustrated in FIG. 2B includes two LEDs 122, other embodiments of the illumination circuit 104 may include a single light source, or more than two light sources. In the case of a single light source, the illumination circuit 104 may include a mechanical or an electromechanical structure such as a lens and/or aperture system (not shown) to transmit to the light to one or both of the light guide layers 110 and 112. In implementations which use more than two light sources, multiple light sources may be used to illuminate a single light guide layer. For example, some embodiments may use multiple LEDs 122 to illuminate a single light guide layer in order to increase the brightness or improve the light distribution pattern of the light within the light guide layer. Also, it should be noted that the light sources may be other types of light sources in addition to or instead of the LEDs 122 shown in FIG. 2B.

Figure 3A:
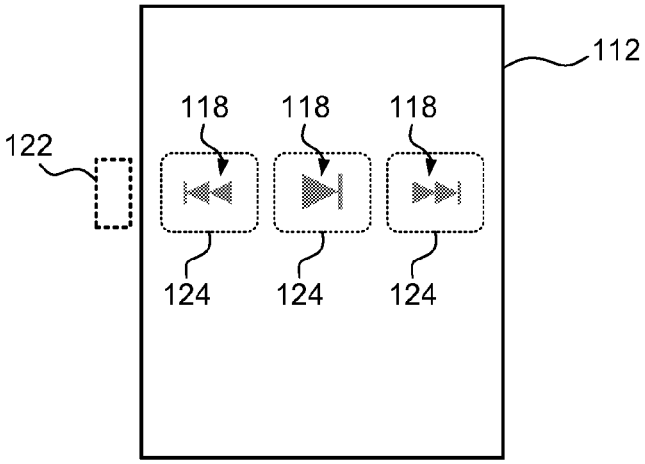
FIG. 3A depicts a schematic diagram of a more detailed embodiment of the second light guide layer of the light guide display shown in FIG. 2A.

FIG. 3A depicts a schematic diagram of a more detailed embodiment of the second light guide layer 112 of the light guide display 100 shown in FIG. 2A. Also, FIG. 3A depicts a location (shown dashed) of an LED 122 located approximately adjacent to the second light guide layer 112. This location, for example, of an LED 122 allows the LED 122 to emit light into a side interface of the second light guide layer 112 in order to internally illuminate the second light guide layer 112 through TIR.

The illustrated second light guide layer 112 includes a plurality of surface feature patterns 118 which are arranged in the form of symbols integrated into the second light guide layer 112. In particular, the surface feature patterns 118 shown in FIG. 3A are arranged to depict symbols that are commonly used in a music player to indicate playback modes, including reverse, play, and forward. Other embodiments may include surface feature patterns 118 arranged to depict other symbols. Each symbol emits light out of the second light guide layer 112 upon illumination of the second light guide layer 112 by the corresponding light source. Thus, for example, when the second light guide layer 112 is illuminated, the illustrated second light guide layer 112 conveys three symbols for music playback modes to a user.

Also, each symbol is within a corresponding input region 124, or input selection region. Examples of boundaries of the input regions 124 are shown with dashed lines, although the boundaries of the input regions 124 may or may not be perceptible to the user. The input regions 124 are aligned with specific switching devices 114 of the switch circuit 108, and the processor circuit 102 processes a user input selection in response to activation of each switching device 114. Since the processor circuit 102 implements functionality corresponding to the illuminated light guide layer (i.e., the second light guide layer 112, in this example), the processor circuit 102 implements playback mode functionality when the second light guide layer 112 is illuminated. Hence, if the user selects one of the illuminated playback modes (e.g., by contacting or depressing one of the corresponding input regions 124), then the processor circuit 102 implements the corresponding playback mode. In some embodiments, the processor circuit 102 switches between certain functional capabilities in response to user selections (e.g., initiation of a music player on the electronic computing device).

Figure 3B:
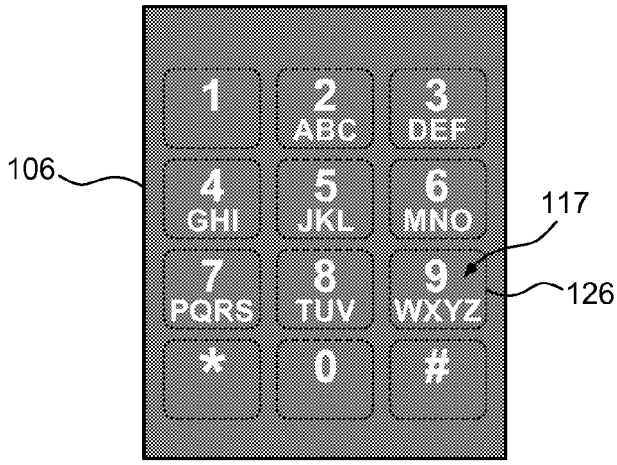
FIG. 3B depicts a schematic diagram of a more detailed embodiment of the printed overlay layer of the light guide display shown in FIG. 2A.

FIG. 3B depicts a schematic diagram of a more detailed embodiment of the printed overlay layer 106 of the light guide display 100 shown in FIG. 2A. Similar to the second light guide layer 112 of FIG. 3A, the printed overlay layer 106 of FIG. 3B includes a plurality of input regions 126 (delineated by dashed lines). Each input region 126 is aligned with a switching device 114 of the switch circuit 108 so that the processor circuit 102 can identify specific input selections by the user.

It should be noted that FIG. 3B does not depict any adjacent LED locations because the illumination for the printed overlay layer 106 originates at the first light guide layer 110 (see FIG. 3C) rather than at the printed overlay layer 106. For this reason, the printed overlay layer 106 includes at least partially translucent portions 117 in each of the input regions 126. In the illustrated embodiment, the partially translucent portions 117 are depicted in the form of alphanumeric characters (specifically, numbers and letters corresponding to the keys of a conventional telephone). Thus, in the illustrated embodiment, the translucent portions 117 correspond to the symbols themselves. However, in other embodiments, the translucent portions 117 may delineate the symbols in other ways (e.g., the symbols may be opaque, and the portions surrounding the symbols may be translucent) or the translucent portions 117 may simply be indicative of the input regions 126, generally (e.g., translucent shapes to approximately delineate each input region 126). There is no limitation as to which part of the input regions 126 might be translucent.

It should also be noted that at least some of the input regions 126 of the printed overlay layer 106 are aligned with at least some of the input regions 124 of the second light guide layer 112. This means that the input regions 126 of the printed overlay layer 106 which align with the input regions 124 of the second light guide layer 112 each correspond to the same switching devices 114 of the switch circuit 108. In the illustrated embodiments of FIGS. 3A and 3B, the input regions 126 corresponding to the numbers 4, 5, and 6 of the printed overlay layer 106 overlap with the input regions 124 corresponding to the reverse, play, and forward playback modes of the second light guide layer 112, at least when the second light guide layer 112 is located on top of the printed overlay layer 106, as shown in FIG. 2A.

The processor circuit 102 implements separate functionality for each of the input regions 124 and 126, depending on which input regions 124 and 126 are illuminated by the illumination circuit 104. For example, if the second light guide layer 112 is illuminated, then the processor circuit 102 implements playback mode controls upon activation of one of the switching devices 114 corresponding to the input regions 124 of the second light guide layer 112. In contrast, if translucent portions 117 of the printed overlay layer 106 are illuminated (e.g., via illumination of the first light guide layer 110), then the processor circuit 102 implements alphanumeric selections upon activation of the switching devices 114 corresponding to the input regions 126 of the printed overlay layer 106. In this way, the processor circuit 102 can distinguish between input selections corresponding to the printed overlay layer 106 and input selections corresponding to the second light guide layer 112, depending on which layer is illuminated by the illumination circuit 104.

Figure 3C:
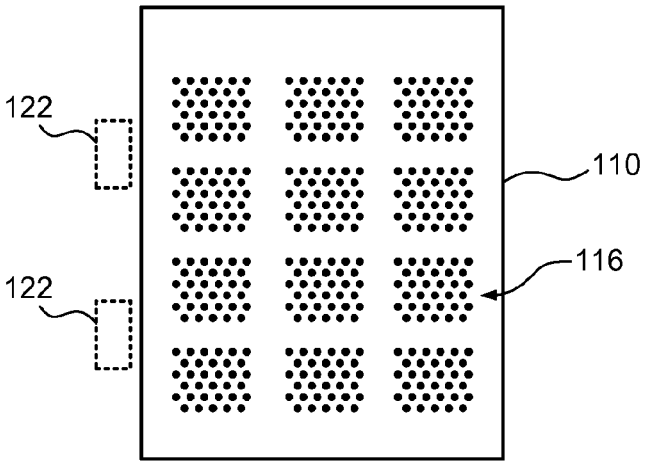
FIG. 3C depicts a schematic diagram of a more detailed embodiment of the first light guide layer of the light guide display shown in FIG. 2A.

FIG. 3C depicts a schematic diagram of a more detailed embodiment of the first light guide layer 110 of the light guide display shown 100 in FIG. 2A. The illustrated first light guide layer 110 includes a plurality of surface feature patterns 116 which correspond to each of the input regions 126 and/or translucent portions 117 of the printed overlay layer 106. When the first light guide layer 110 is illuminated, light exits the surface feature patterns 116 of the first light guide layer 110 to illuminate the translucent portions 117 of the printed overlay layer 106. Also, FIG. 3C depicts two locations (shown dashed) of LEDs 122 located approximately adjacent to the first light guide layer 110. These locations, for example, of LEDs 122 allow the LEDs 122 to emit light into separate locations of a side interface of the first light guide layer 110 in order to internally illuminate the first light guide layer 110 through TIR.

Figure 4:
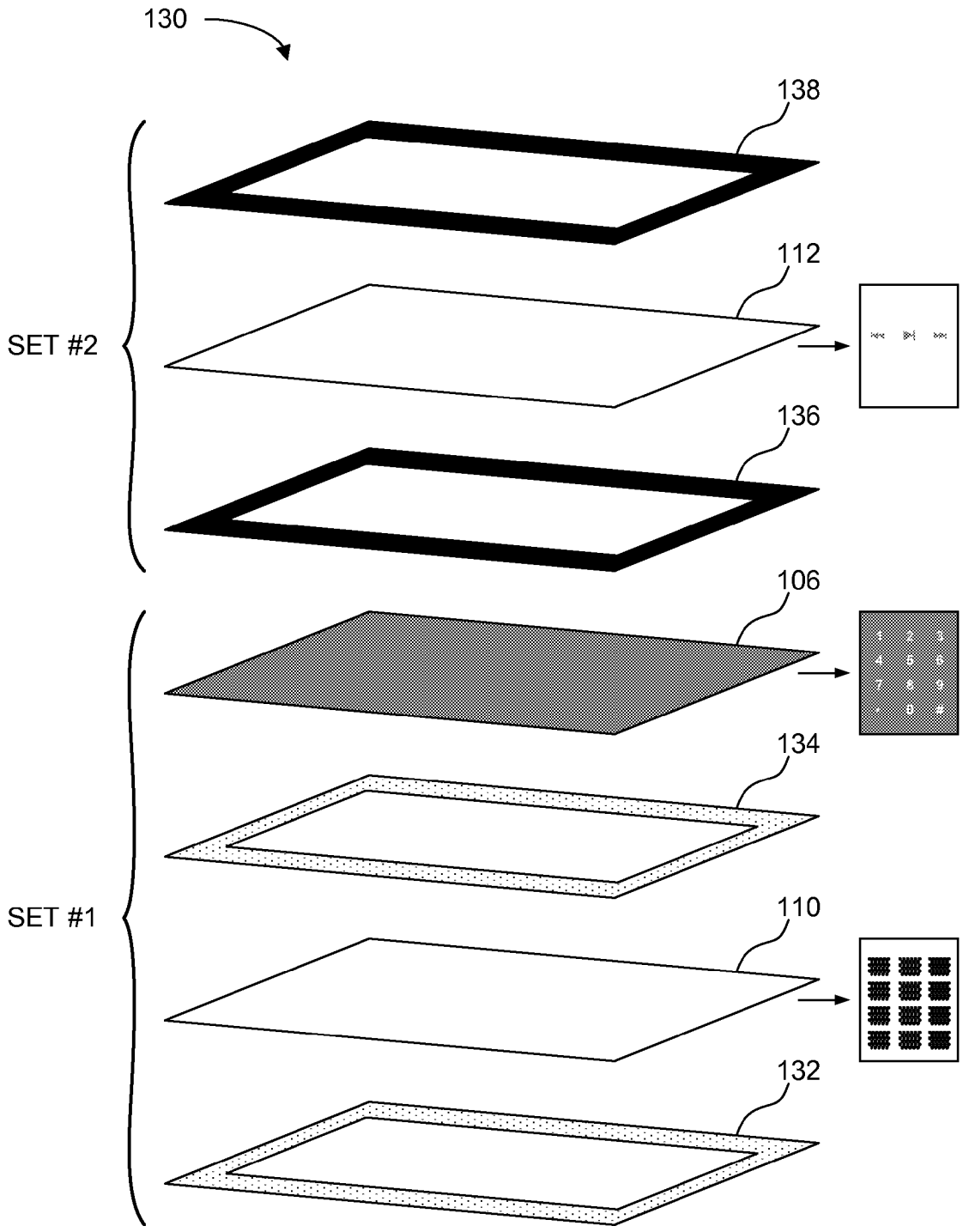
FIG. 4 depicts a schematic diagram of a more detailed embodiment of a layered stack assembly of the light guide display shown in FIG. 2A.

FIG. 4 depicts a schematic diagram of a more detailed embodiment of a layered stack assembly 130 of the light guide display 100 shown in FIG. 2A. In the illustrated embodiment, the various layers of the layered stack assembly 130 are subdivided into two sets. The first set, Set #1, generally corresponds to illumination of the first light guide layer 110 and the printed overlay layer 106. The second set, Set #2, generally corresponds to illumination of the second light guide layer 112. However, the designation of specific layers within a particular set is merely for purposes of description herein and should not be construed as limiting in any way. Additionally, in some embodiments, the order of the layers may be altered and/or fewer or more layers may be implemented in one or both sets of layers.

In one embodiment, the first set of layers includes a base bonding layer 132, the first light guide layer 110, an intermediate bonding layer 134, and the printed overlay layer 106. For reference only, the illustrations of FIGS. 3C and 3B are shown adjacent to the first light guide layer 110 and the printed overlay layer 106, respectively. The base bonding layer 132 includes an adhesive material to hold the entire, assembled stack of layers to the switch circuit 108 (see FIG. 2A) or another base substrate (not shown) during the dome sheet assembly process. In one example, the resulting thickness of the base bonding layer 132 is about 0.05 mm. The first light guide layer 110 distributes light from one or more light sources of the illumination circuit 104. In one example, the thickness of the first light guide layer 110 is about 0.125 mm. The intermediate bonding layer 134 includes an adhesive material to provide a bond between the first light guide layer 110 and the printed overlay layer 106. In one embodiment, the resulting thickness of the intermediate bonding layer 134 is about 0.03 mm. In one embodiment, the thickness of the printed overlay layer 106 is about 0.1 mm. Although specific examples of thicknesses are provided herein for the layers within the first set of layers, other embodiments may use layers with different thicknesses. Also, as shown, the base and intermediate adhesive layers 132 and 134 are applied to the perimeter of the first light guide layer 110 and the printed overlay layer 106, although other embodiments may use one or more of the adhesive layers in other locations.

In one embodiment, the second set of layers includes a first light curtain layer 136, the second light guide layer 112, and a second light curtain layer 138. For reference only, the illustration of FIG. 3A is shown adjacent to the second light guide layer 112. The first light curtain layer 136 is disposed between the printed overlay layer 106 and the second light guide layer 112, around a perimeter of the printed overlay layer 106, to at least partially block light leakage from the first light guide layer 110 and the printed overlay layer 106 to the second light guide layer 112. In some embodiments, the first light curtain layer 136 is a double-sided tape. In this way, the first light curtain layer 136 acts as a light leakage seal and spacer when the first light guide layer 110 is illuminated by the illumination circuit 104. In one embodiment, the thickness of the first light curtain layer 136 is about 0.068 mm. The second light guide layer 112 distributes light from one or more light sources of the illumination circuit 104 to illuminate input regions 124 integrated into the second light guide layer 112. In one example, the thickness of the second light guide layer 112 is about 0.125 mm. The second light curtain layer 138 is disposed on a top surface of the second light guide layer 112, around a perimeter of the second light guide layer 112, to at least partially block light leakage from the second light guide layer 112. The second light curtain layer 138 also may prevent ambient light from internally illuminating the second light guide layer 112. In this way, the second light curtain layer 138 facilitates cosmetic purposes to create a total darkness contrast to the display unit when all of the light sources are switched off. The second light curtain layer 138 may be a single- or double-sided tape. In one example, the thickness of the second light curtain layer 138 is about 0.05 mm. Although specific examples of thicknesses are provided herein for the layers within the second set of layers, other embodiments may use layers with different thicknesses.

Figure 5:
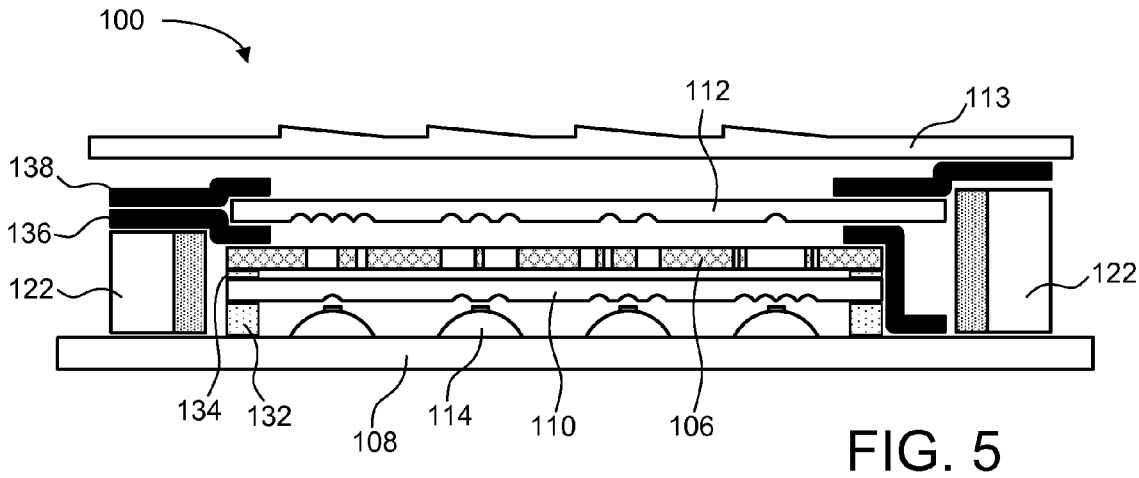
FIG. 5 depicts a schematic block diagram of another embodiment of a light guide display with the layered stack assembly shown in FIG. 4.

FIG. 5 depicts a schematic block diagram of another embodiment of a light guide display 100 with the layered stack assembly 130 shown in FIG. 4. The illustrated light guide display 100 includes the keypad layer 113 and the switch circuit 108. The layered stack assembly 130 and corresponding light sources 122 are disposed between the light keypad layer 113 and the switch circuit 108, and the input regions of the various layers are aligned with the switching devices 114 of the switch circuit 108.

Figure 6A:
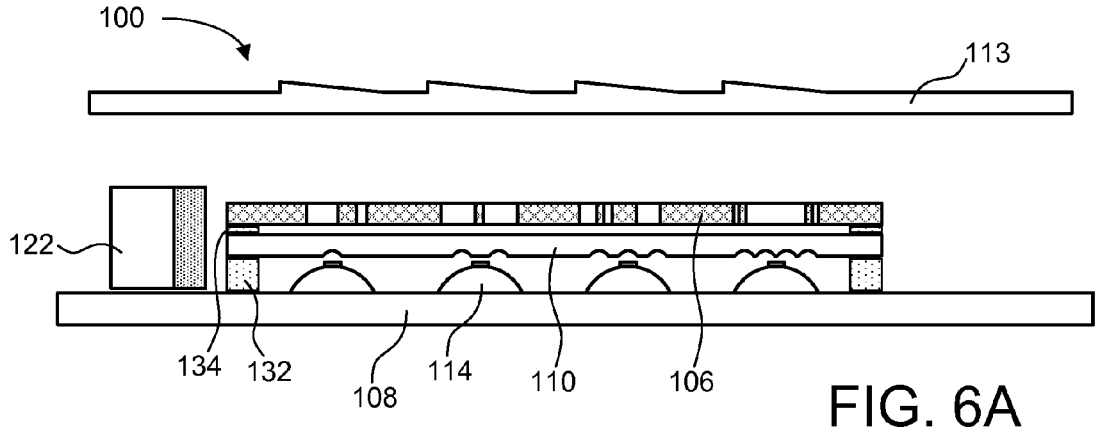
FIG. 6A depicts the layers corresponding to Set #1 of the layered stack assembly of FIG. 4 within the light guide display of FIG. 5.

In particular, the layered stack assembly 130 includes the base bonding layer 132, the first light guide layer 110, the intermediate bonding layer 134, and the printed overlay layer 106. These four layers correspond to Set #1 of the layered stack assembly 130 of FIG. 4. FIG. 6A depicts the layers corresponding to Set #1 of the layered stack assembly 130 of FIG. 4 within the light guide display 100 of FIG. 5. FIG. 6A shows the layers of Set #1 between the keypad layer 113 and the switch circuit 108, and also shows the light source 122 corresponding to the first light guide layer 110.

Figure 6B:
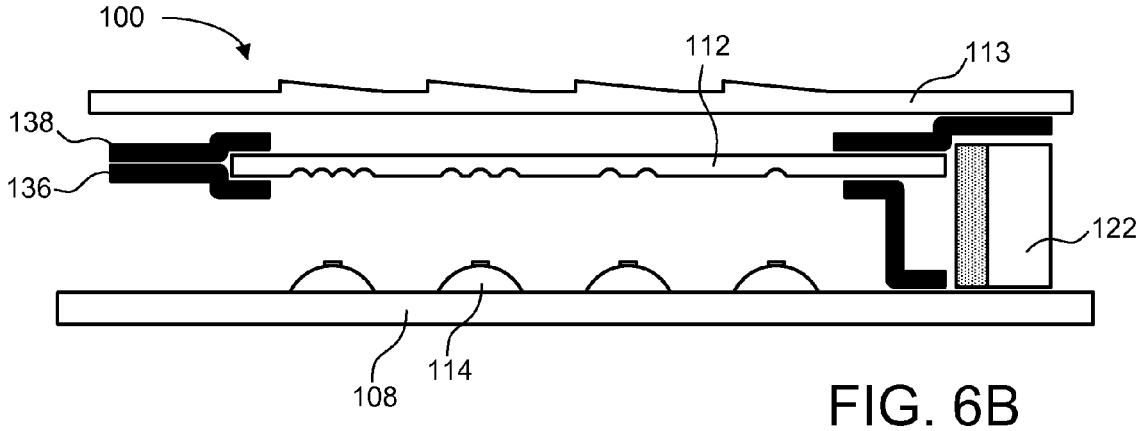
FIG. 6B depicts the layers corresponding to Set #2 of the layered stack assembly of FIG. 4 within the light guide display of FIG. 5.

The illustrated layered stack assembly 130 also includes the first light curtain layer 136, the second light guide layer 112, and the second light curtain layer 138. These three layers correspond to Set #2 of the layered stack assembly 130 of FIG. 4. FIG. 6B depicts the layers corresponding to Set #2 of the layered stack assembly 130 of FIG. 4 within the light guide display 100 of FIG. 5. FIG. 6B shows the layers of Set #2 between the keypad layer 113 and the switch circuit 108, and also shows the light source 122 corresponding to the second light guide layer 112.

Figure 7A:
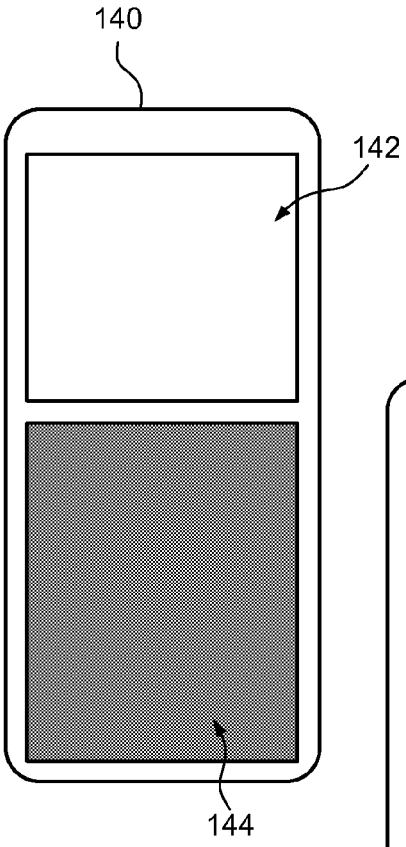
FIG. 7A depicts a schematic diagram of one embodiment of an electronic computing device with the light guide display in a display off mode.

FIG. 7A depicts a schematic diagram of one embodiment of an electronic computing device 140 with the light guide display 100 in a display off mode. The illustrated electronic computing device 140 is a mobile communications device, such as a telephone, smart phone, PDA, etc., with a display screen 142 and a keypad area 144 implemented by the light guide display 100 of FIG. 2A. In the display off mode, the illumination circuit 104 does not illuminate either the first or second light guide layers 110 and 112, so the keypad area 144 appears to be substantially blank. In particular, there are no symbols illuminated within the keypad area 144.

Figure 7B:
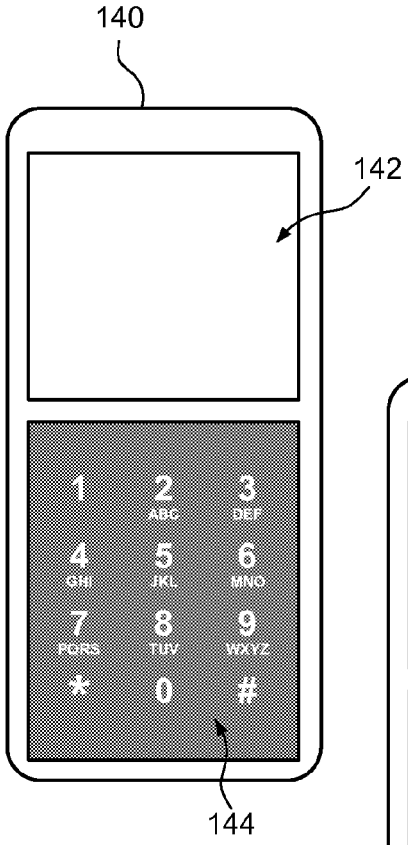
FIG. 7B depicts a schematic diagram of one embodiment of the electronic computing device of FIG. 7A with the light guide display in a first display mode.

FIG. 7B depicts a schematic diagram of one embodiment of the electronic computing device 140 of FIG. 7A with the light guide display 100 in a first display mode. In the first display mode, the processor circuit 102 controls the illumination circuit 104 to illuminate the first light guide layer 110, which transmits light through the translucent portions 117 of the printed overlay layer 106. This allows the user to see that the possible input selections include alphanumeric characters (or corresponding functions) illuminated within the printed overlay layer 106. In the first display mode, the separate symbols (i.e., the music playback symbols) of the second light guide layer 112 are substantially transparent, so the separate symbols of the second light guide layer 112 are essentially imperceptible to the user.

Figure 7C:
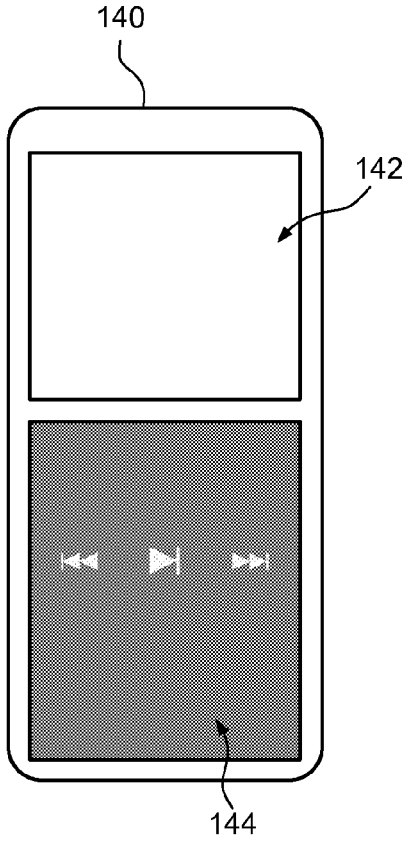
FIG. 7C depicts a schematic diagram of one embodiment of the electronic computing device of FIG. 7A with the light guide display in a second display mode.

FIG. 7C depicts a schematic diagram of one embodiment of the electronic computing device 140 of FIG. 7A with the light guide display 100 in a second display mode. In the second display mode, the processor circuit 102 controls the illumination circuit 104 to illuminate the second light guide layer 112, which transmits light through the second light guide layer 112, including the symbols of the second light guide layer 112. This allows the user to see that the possible input selections include, for example, music playback selections (or corresponding functions) illuminated within the second light guide layer 112. In the second display mode, the symbols (i.e., the alphanumeric characters) of the printed overlay layer 106 are substantially dark because the first light guide layer 110 is not illuminated, so the symbols of the printed overlay layer 106 are essentially imperceptible to the user.

Although the embodiments shown in the appended figures and described herein describe two layers of symbol illumination, other embodiments of the electronic computing device 140 and/or the light guide display 100 may implement more than two layers of symbol illumination. For example, another embodiment may include a third light guide layer (not shown) disposed on top of the second light guide layer 112, and the processor circuit 102 may control the illumination circuit 104 to separately illuminate the third light guide layer to exclusively illuminate the symbols of the third light guide layer.

Figure 8:
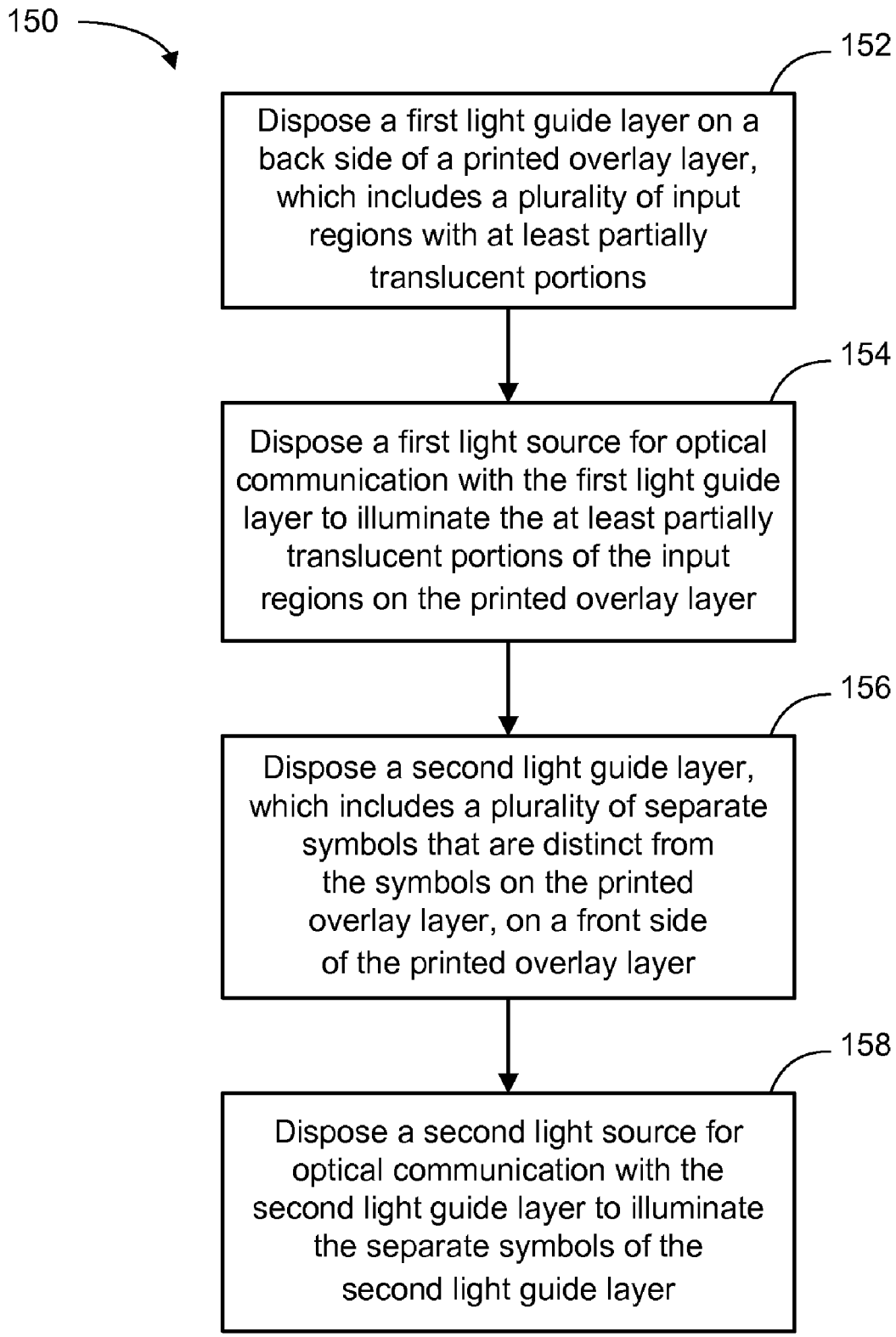
FIG. 8 depicts a flow chart diagram of one embodiment of a method for manufacturing a light guide display with multiple light guide layers.

FIG. 8 depicts a flow chart diagram of one embodiment of a method 150 for manufacturing a light guide display 100 with multiple light guide layers 110 and 112. Although the method 150 is described in conjunction with the light guide display 100 of FIG. 2A, embodiments of the method 150 may be implemented with other types of light guide displays.

At block 152, a first light guide layer 110 is disposed on a back side of a printed overlay layer 106. As explained above, the printed overlay layer 106 includes a plurality of input regions 126 with at least partially translucent portions 117. At block 154, a first light source 122 is disposed for optical communication with the first light guide layer 110. The first light source 122 illuminates the first light guide layer 110 and, hence, illuminates the at least partially translucent portions 117 of the input regions 126 on the printed overlay layer 106. At block 156, a second light guide layer 112 is disposed on a front side of the printed overlay layer 106. The second light guide layer 112 includes a plurality of separate symbols 118 that are distinct from the symbols 117 of the printed overlay layer 106. At block 158, a second light source 122 is disposed for optical communication with the second light guide layer 112. The second light source 122 illuminates the separate symbols 118 of the second light guide layer 112, as explained above. The depicted method 150 then ends.

In further embodiments, the method 150 may include further operations related to manufacturing the light guide display 100. In particular, in one embodiment, the method 150 also includes disposing a switch circuit 108 on a back side of the first light guide layer 110, opposite the printed overlay layer 106. The switch circuit 108 includes a plurality of switching devices 114 aligned with overlapping viewable regions 124 and 126 of the light guide display 100 in which the symbols 117 of the printed overlay layer 106 and the separate symbols 118 of the second light guide layer 112 are aligned. As explained above, application of an external force or contact on one of the viewable regions activates a corresponding switching device 114 of the switch circuit 108.

In a further embodiment, the method 150 also includes electrically coupling a processor circuit 102 to the switch circuit 108. The processor circuit 102 processes an input selection in response to activation of a switching device 114 of the switch circuit 108.

In a further embodiment, the method 150 includes electrically coupling the processor circuit 102 to the first and second light sources 122. The processor circuit 102 controls the first and second light guide layers 110 and 112 to illuminate the first and second light guide layers 110 and 112, respectively. More specifically, the processor circuit 102 controls the illumination circuit 104 to exclusively illuminate the first or second light sources 122 in synchronization with enablement of functionality that is unique to each of the first and second light guide layers 110 and 112.

In another embodiment, the method 150 also includes applying an adhesive between the first light guide layer 110 and the printed overlay layer 106 to bond the first light guide layer 110 to the back side of the printed overlay layer 106. The method 150 also includes disposing a first light curtain layer 136 between the printed overlay layer 106 and the second light guide layer 112. Specifically, the first light curtain layer 136 is disposed around a perimeter of the printed overlay layer 106. As explained above, the first light curtain layer 136 at least partially blocks light leakage from the first light guide layer 110 and the printed overlay layer 106 into the second light guide layer 112. The method 150 also includes disposing a second light curtain layer 138 on a top surface of the second light guide layer 112. Specifically the second light curtain layer 138 is disposed around a perimeter of the second light guide layer 112 to at least partially block light leakage from the second light guide layer 112 and/or to prevent ambient light from illuminating one or more layers of the light guide display 100.

Figure 9:
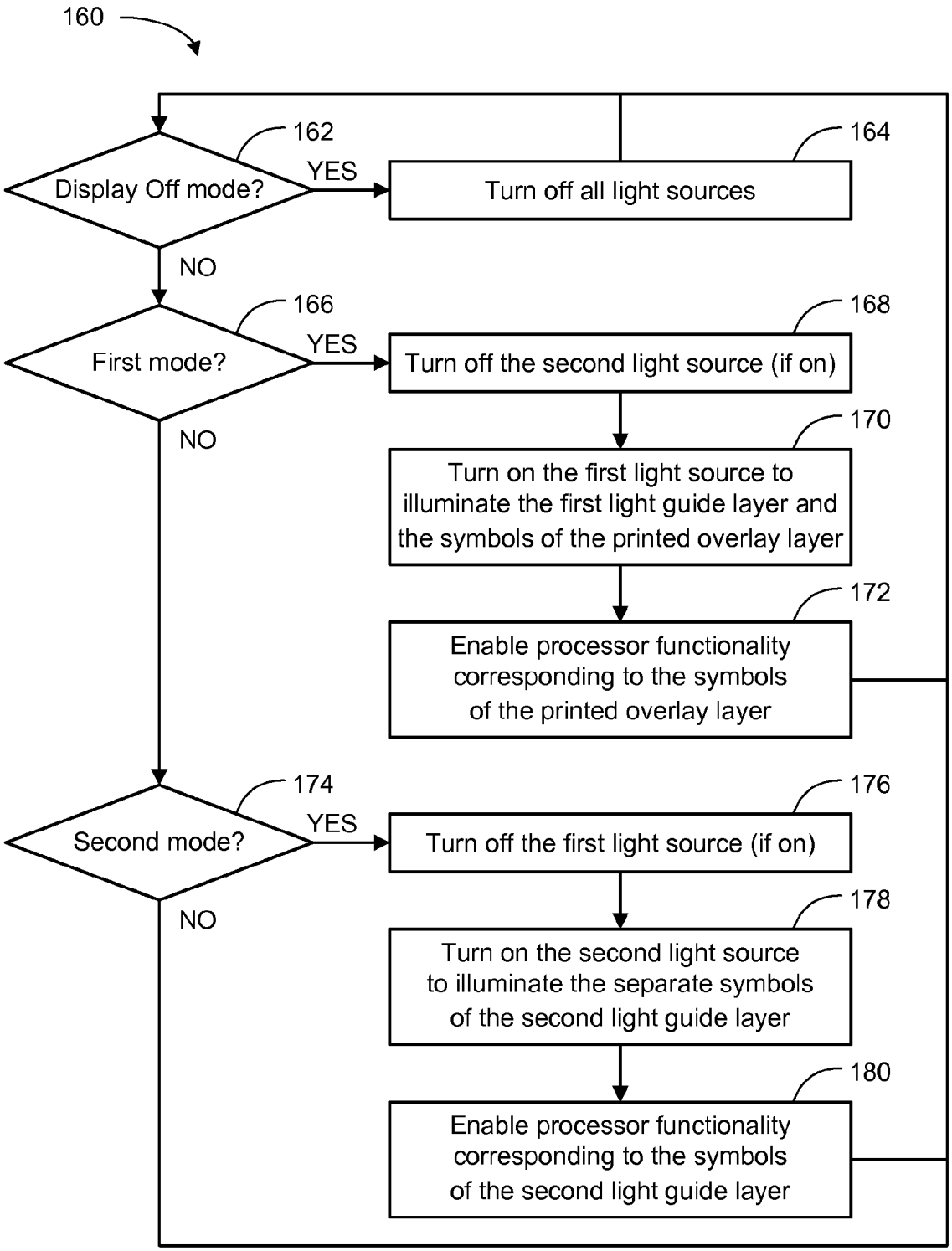
FIG. 9 depicts a flow chart diagram of one embodiment of a method for operating a light guide display with multiple light guide layers.

FIG. 9 depicts a flow chart diagram of one embodiment of a method 160 for operating a light guide display 100 with multiple light guide layers. Although the method 160 is described in conjunction with the light guide display 100 of FIG. 2A, embodiments of the method 160 may be implemented with other types of light guide displays.

At block 162, the processor circuit 102 determines if the display off mode is invoked. If the display off mode is invoked, then at block 164 the processor circuit 102 controls the illumination circuit 104 to turn off all of the light sources 122. The resulting appearance of the light guide display 100 in the display off mode is represented by the illustration in FIG. 7A. The processor circuit 102 continues to maintain the light sources 122 off until the method 160 exits the display off mode. In some embodiments, the display off mode is a default mode for the electronic computing device 140. Additionally, the display off mode may be invoked in conjunction with a sleep mode, after a period of inactivity with the light guide display 100 and/or the electronic computing device 140.

If the display off mode is not invoked, then at block 166 the processor circuit 102 determines if the first display mode is invoked. If the first display mode is invoked, then at block 168 the processor circuit 102 controls the illumination circuit 104 to turn off the second light source 122 corresponding to the second light guide layer 112, or to make sure that the second light source 122 is already off. At block 170, the processor circuit 102 controls the illumination circuit 104 to turn on the first light source 122 to illuminate the first light guide layer 110 and, hence, illuminate the substantially translucent portions 117 of the printed overlay layer 106. At block 172, the processor circuit 102 enables functionality corresponding to the symbols of the printed overlay layer 106 and the first light guide layer 110. One example of the resulting appearance of the light guide display 100 in the first display mode is represented by the illustration in FIG. 7B. In one embodiment, the processor circuit 102 maintains the first display mode until another mode is initiated.

If the display off mode and the first display mode are not invoked, then at block 174 the processor circuit 102 determines if the second display mode is invoked. If the second display mode is invoked, then at block 176 the processor circuit 102 controls the illumination circuit 104 to turn off the first light source 122 corresponding to the first light guide layer 110, or to make sure that the first light source 122 is already off. At block 178, the processor circuit 102 controls the illumination circuit 104 to turn on the second light source 122 to illuminate the second light guide layer 112, including the symbols of the second light guide layer 112. At block 180, the processor circuit 102 enables functionality corresponding to the symbols of the second light guide layer 112. One example of the resulting appearance of the light guide display 100 in the second display mode is represented by the illustration in FIG. 7C. In one embodiment, the processor circuit 102 maintains the second display mode until another mode is initiated. The depicted method 160 then ends.

From the appended figures and the description herein, it can be understood that embodiments of the light guide display 100 implement a segmented light display system in which different overlapping input selection symbols can be alternatively displayed to a user within the same input regions. Embodiments of light separation on separate light guide layers (e.g., films) can be done effectively, even though it is not possible or it would be very difficult to implemented similar functionality using a single light guide layer. Also, in some embodiments, the number of components within an electronic computing device and, more specifically, a light guide display may be reduced by using less switching circuitry to implement a larger number of distinct functions. In this way, the size and component resources can be leveraged to implement at least the same functionality in a smaller device or, alternatively, to implement significantly more functionality in the same size of device.

In the above description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. A light guide display comprising:

a printed overlay layer comprising an input region, wherein the input region comprises a symbol that is at least partially translucent through a thickness of the printed overlay layer;

a first light guide layer disposed on a back side of the printed overlay layer, the first light guide layer to receive light and to distribute the light at least partially according to total internal reflection (TIR) to an illumination region aligned with the symbol of the printed overlay layer, wherein the first light guide layer is configured to illuminate the symbol of the printed overlay layer in response to illumination of the first light guide layer;

a second light guide layer disposed on a front side of the printed overlay layer, opposite the first light guide layer, the second light guide layer comprising a separate symbol that is distinct from the symbol of the printed overlay layer, wherein the second light guide layer is configured to illuminate the separate symbol of the second light guide layer in response to illumination of the second light guide layer; and a first light curtain layer disposed between the printed overlay layer and the second light guide layer, around a perimeter of the printed overlay layer, wherein the first light curtain layer is configured to at least partially block light leakage from the first light guide layer and the printed overlay layer to the second light guide layer.

2. The light guide display of claim 1, further comprising:

an illumination circuit to generate the light for the first and second light guide layers; and a processor circuit coupled to the illumination circuit, the processor circuit to control the illumination circuit for mutually exclusive illumination of the first and second light guide layers.

3. The light guide display of claim 2, wherein the symbol of the printed overlay layer and the separate symbol of the second light guide layer are aligned in an overlapping viewable region of the light guide display, wherein the processor circuit is configured to implement a first function in response to a selection of the viewable region during illumination of the symbol of the printed overlay layer, and the processor circuit is configured to implement a second function in response to a selection of the viewable region during illumination of the separate symbol of the second light guide layer.

4. The light guide display of claim 2, wherein the illumination circuit comprises:

a first light source disposed relative to the first light guide layer to illuminate an internal portion of the first light guide layer; and a second light source disposed relative to the second light guide layer to illuminate an internal portion of the second light guide layer.

5. The light guide display of claim 2, further comprising a switch circuit having a switching device aligned with the symbol of the printed overlay layer, wherein the processor circuit is further configured to process an input selection in response to activation of the switching device.

6. The light guide display of claim 1, further comprising a second light curtain layer disposed on a top surface of the second light guide layer, around a perimeter of the second light guide layer, wherein the second light curtain layer is configured to at least partially block light leakage from the second light guide layer.

7. The light guide display of claim 1, wherein the first and second light guide layers comprise light guide films, each light guide film having a thickness of less than about 0.2 mm.

8. An electronic computing device comprising:

a light guide display with a plurality of light guide layers, wherein each light guide layer corresponds to a unique set of user input selections;

an illumination circuit to independently illuminate each light guide layer;

an intermediate printed overlay layer to reflect light from one of the plurality of light guide layers located on a front side of the intermediate printed overlay layer and to form a unique set of user input selections corresponding to another of the plurality of light guide layers located on a back side of the intermediate printed overlay layer; and a processor circuit coupled to the light guide display, the processor circuit to independently enable each unique set of user input selections during illumination of the corresponding light guide layer.

9. The electronic computing device of claim 8, wherein the illumination circuit is configured to illuminate at most one light guide layer at a time, and the processor circuit is configured to enable the unique set of user input selections corresponding to the illuminated light guide layer.

10. The electronic computing device of claim 9, wherein the light guide display further comprises a switch circuit having a plurality of switching devices aligned with input selection regions of the printed overlay layer, wherein the processor circuit is further configured to process the user input selections in response to activation of the switching devices.

11. The electronic computing device of claim 8, wherein at least one of the light guide layers of the light guide display comprises a plurality of symbols integrated into the light guide layer, wherein each symbol emits light out of the light guide layer upon illumination of the light guide layer.

12. The electronic computing device of claim 8, wherein the illumination circuit comprises:

a first light source disposed relative to a first light guide layer to illuminate an internal portion of the first light guide layer; and a second light source disposed relative to a second light guide layer to illuminate an internal portion of the second light guide layer;

wherein both of the first and second light guide layers distribute the light at least partially according to total internal reflection (TIR).

13. The electronic computing device of claim 8, wherein the light guide layers comprise light guide films, each light guide film having a thickness of less than about 0.2 mm.

14. A method for manufacturing a light guide display, the method comprising:

disposing a first light guide layer on a back side of a printed overlay layer, wherein the printed overlay layer comprises a plurality of input regions with at least partially translucent portions;

disposing a first light source for optical communication with the first light guide layer, the first light source to illuminate the first light guide layer and to illuminate the at least partially translucent portions of the input regions on the printed overlay layer upon illumination of the first light guide layer;

disposing a second light guide layer on a front side of the printed overlay layer, wherein the second light guide layer comprises a plurality of separate symbols that are distinct from the symbols of the printed overlay layer; and disposing a second light source for optical communication with the second light guide layer, the second light source to illuminate the separate symbols of the second light guide layer.

15. The method of claim 14, further comprising disposing a switch circuit on a back side of the first light guide layer, opposite the printed overlay layer, the switch circuit comprising a plurality of switching devices aligned with overlapping viewable regions of the light guide display in which the symbols of the printed overlay layer and the separate symbols of the second light guide layer are aligned, wherein application of an external force on one of the viewable regions is configured to activate a corresponding switching device.

16. The method of claim 15, further comprising electrically coupling a processor circuit to the switch circuit, wherein the processor circuit is configured to process an input selection in response to activation of the switching device.

17. The method of claim 16, further comprising electrically coupling the processor circuit to the first and second light sources, wherein the processor circuit is configured to control the first and second light sources to illuminate the first and second light guide layers, respectively, in synchronization with enablement of functionality that is unique to each of the first and second light guide layers.

18. The method of claim 14, further comprising:

applying an adhesive between the first light guide layer and the printed overlay layer to bond the first light guide layer to the back side of the printed IS overlay layer, wherein the first light guide layer comprises a light guide film having a thickness of less than about 0.25 mm;

disposing a first light curtain layer between the printed overlay layer and the second light guide layer, around a perimeter of the printed overlay layer, wherein the first light curtain layer is configured to at least partially block light leakage from the first light guide layer and the printed overlay layer to the second light guide layer;

disposing a second light curtain layer on a top surface of the second light guide layer, around a perimeter of the second light guide layer, wherein the second light curtain layer is configured to at least partially block light leakage from the second light guide layer; and disposing a substantially translucent keypad layer on top of the second light curtain layer and the second light guide layer, wherein the substantially translucent keypad layer is configured to transmit light from at least one of the first and second light guide layers for perception by a user.

* * * * *